US010063015B2

(12) United States Patent
Zhao et al.

(10) Patent No.: US 10,063,015 B2
(45) **Date of Patent: *Aug. 28, 2018**

(54) RECEPTACLE CONNECTOR HAVING IMPROVED SHIELDING PLATE

(71) Applicant: FOXCONN INTERCONNECT TECHNOLOGY LIMITED, Grand Cayman (KY)

(72) Inventors: Jun Zhao, Huaian (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/605,966

(22) Filed: May 26, 2017

(65) Prior Publication Data

US 2017/0264054 A1 Sep. 14, 2017

Related U.S. Application Data

(63) Continuation-in-part of application No. 15/088,155, filed on Apr. 1, 2016, now Pat. No. 9,667,001, and a (Continued)

(30) Foreign Application Priority Data

Feb. 11, 2015 (CN) ..... 2015 1 0069505
Apr. 2, 2015 (CN) ..... 2015 1 0153882

(51) Int. Cl.
*H01R 13/6593* (2011.01)
*H01R 13/627* (2006.01)
*H01R 43/00* (2006.01)

(52) U.S. Cl.
CPC ..... *H01R 13/6593* (2013.01); *H01R 13/627* (2013.01); *H01R 43/007* (2013.01)

(58) Field of Classification Search
CPC . H01R 13/6593; H01R 13/627; H01R 43/007
(Continued)

(56) References Cited

U.S. PATENT DOCUMENTS 7,758,379 B2 * 7/2010 Chen ..... H01R 13/6485 439/607.11
8,109,795 B2 * 2/2012 Lin ..... H01R 13/6461 439/660

(Continued)

FOREIGN PATENT DOCUMENTS

CN 201927757 U 8/2011
CN 203871583 U 10/2014

(Continued)

*Primary Examiner* — Alexander Gilman
(74) *Attorney, Agent, or Firm* — Wei Te Chung; Ming Chieh Chang

(57) ABSTRACT

A receptacle includes a first and a second insulating housing, and a shielding plate. The first housing has a first base and a first tongue extending forwardly, the first tongue having a slant connection portion located close to the first base. The second housing has a second base and a second tongue extending forwardly, the second tongue has a slant connection portion located close to the second base. A plurality of first contacts is carried within the first housing, a plurality of second contacts is carried within the second housing. Each contact has a contacting portion, an affixed portion, and a soldering portion. The plate is sandwiched between the first and second housing and has a slant connection portion sandwiched between the connection portions of the two housing. The first housing defines a first stepping portion going through an opening on the plate and pressing against the second housing.

14 Claims, 18 Drawing Sheets

Related U.S. Application Data continuation-in-part of application No. 15/011,673, filed on Feb. 1, 2016, now Pat. No. 9,711,910.

(58) Field of Classification Search
USPC ..... 439/607.08
See application file for complete search history.

(56) References Cited

U.S. PATENT DOCUMENTS 8,282,417 B2 * 10/2012 Xiao ..... H01R 13/648 439/607.36
8,851,927 B2 * 10/2014 Hsu ..... H01R 12/724 439/607.11
9,178,319 B2 * 11/2015 Little ..... H01R 13/6585
9,281,625 B2 * 3/2016 Kao ..... H01R 13/6471
9,379,499 B2 * 6/2016 Miyoshi ..... H01R 24/60
9,553,410 B2 * 1/2017 Zhao ..... H01R 13/6581
9,577,387 B2 * 2/2017 Hu ..... H01R 13/6597
9,634,409 B2 * 4/2017 Tsai ..... H01R 12/716
9,768,535 B1 * 9/2017 Wu ..... H01R 12/707
9,768,544 B2 * 9/2017 Du ..... H01R 13/521
9,787,009 B2 * 10/2017 Tsai ..... H01R 12/57
2015/0044886 A1 * 2/2015 Little ..... H01R 12/75 439/55
2015/0079843 A1 * 3/2015 Nakashima ..... H01R 13/6585 439/607.09
2015/0244111 A1 * 8/2015 Ju ..... H01R 13/6585 439/607.05
2015/0311636 A1 * 10/2015 Chang ..... H01R 13/6471 439/607.28
2016/0020560 A1 * 1/2016 Ju ..... H01R 24/78 439/607.05
2016/0104957 A1 * 4/2016 Kim ..... H01R 13/5219 439/78
2016/0104975 A1 * 4/2016 Guo ..... H01R 13/6585 439/607.05
2016/0141805 A1 * 5/2016 Zhao ..... H01R 13/504 439/607.01
2016/0149350 A1 * 5/2016 Kao ..... H01R 12/724 439/607.05

FOREIGN PATENT DOCUMENTS

CN 203983548 U 12/2014
JP 2013-54844 A 3/2013

* cited by examiner

RECEPTACLE CONNECTOR HAVING IMPROVED SHIELDING PLATE

CROSS REFERENCE TO RELATED APPLICATIONS

This application is a continuation-in-part of the co-pending application Ser. No. 15/088,155 filed Apr. 1, 2016, and Ser. No. 15/011,673 filed Feb. 1, 2016, the contents of which are incorporated entirely herein by reference.

BACKGROUND OF THE INVENTION

1. Field of the Invention

The present invention relates to a receptacle connector, and more portionicularly to a receptacle connector having improved shielding plate.

2. Description of Related Art

The Universal Serial Bus and USB connectors are well known in the art. China Patent No. 203871583 discloses a reverse receptacle connector. The receptacle connector includes an insulating housing, a number of contacts, a metal case engaged with the insulating housing, and a shielding shell enclosing the insulating housing. The insulating housing includes a first insulating base, a second insulating base, and a third insulating housing. The first insulating base and the second insulating base shape like cuboids. The third insulating housing defines a third insulating base and a tongue portion extending forwardly from the third base. The contacts include a number of first contacts retained in the first base and a number of second contacts retained in the second base. Each of the first contacts has a first contacting portion pendent from the first base and each of the second contacts has a second contacting portion pendent from the second base. However, the first insulating housing and the second insulating housing respectively resist the contacts and the metal case and the third insulating housing is over-molding with the first insulating housing and the second insulating housing to squeeze and deform the first insulating housing and the second insulating housing.

Hence, a new and simple receptacle connector is desired.

SUMMARY OF THE INVENTION

Accordingly, the object of the present invention is to provide A receptacle connector includes a first insulating housing having a first base portion and a first tongue portion extending forwardly from the first base portion, the first tongue portion having a slant connection portion located close to the first base portion; a second insulating housing having a second base portion and a second tongue portion extending forwardly from the second base portion, the second tongue portion having a slant connection portion located close to the second base portion; a plurality of first contacts carried within the first insulating housing, each first contact having a first contacting portion, a first affixed portion, and a first soldering portion; a plurality of second contacts carried within the second insulating housing, each second contact having a second contacting portion, a second affixed portion, and a second soldering portion; a shielding plate sandwiched between the first insulating housing and the second insulating housing, the shielding plate having a slant connection portion sandwiched between the connection portions of the first and second insulating housing. The connecting portion of the shielding plate defines an opening, the first insulating housing defines a first stepping portion going through the opening and pressing against the second insulating housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
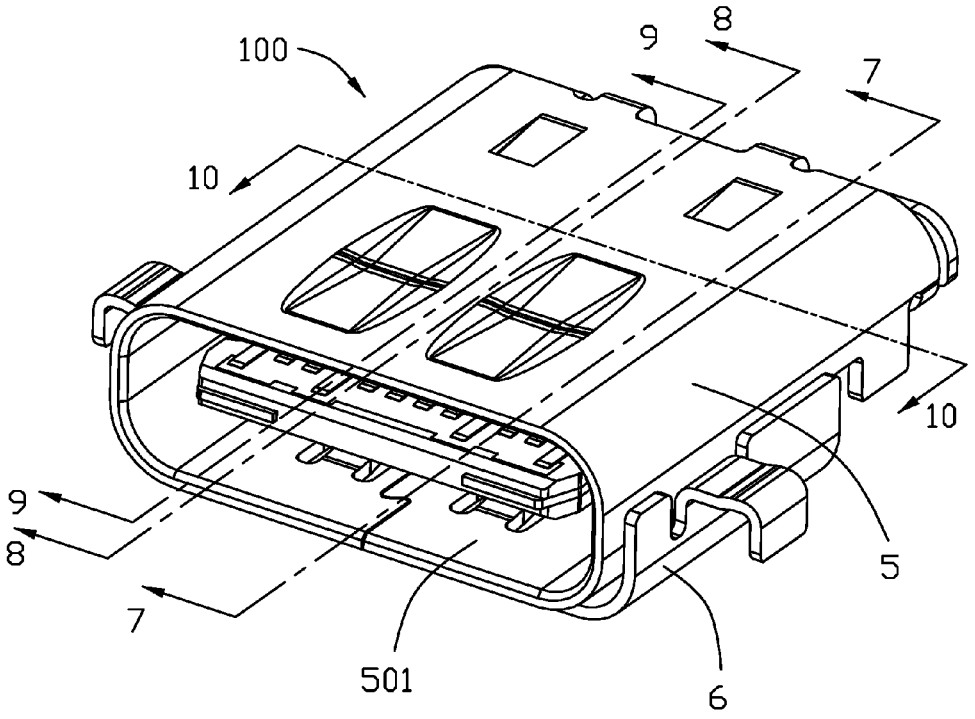
FIG. 1 is a front and top perspective view of a receptacle connector of a first embodiment in accordance with the present invention.

Reference will now be made in detail to the preferred embodiment of the present invention.

FIGS. 1-10 show a first embodiment of a receptacle connector 100 mounted upon a printed circuit board in a sink manner and cooperated with a plug connector. The receptacle connector 100 includes an insulating housing 1, a number of terminals 2 and a metallic shielding plate 3 retained in the insulating housing 1, a glue wall 4 sealing a back of the insulating housing 1, a shielding shell 5 formed with a mating cavity 501 to receive the insulating housing 1, and a metal shell 6 attached to the shielding shell 5.

Figure 4:
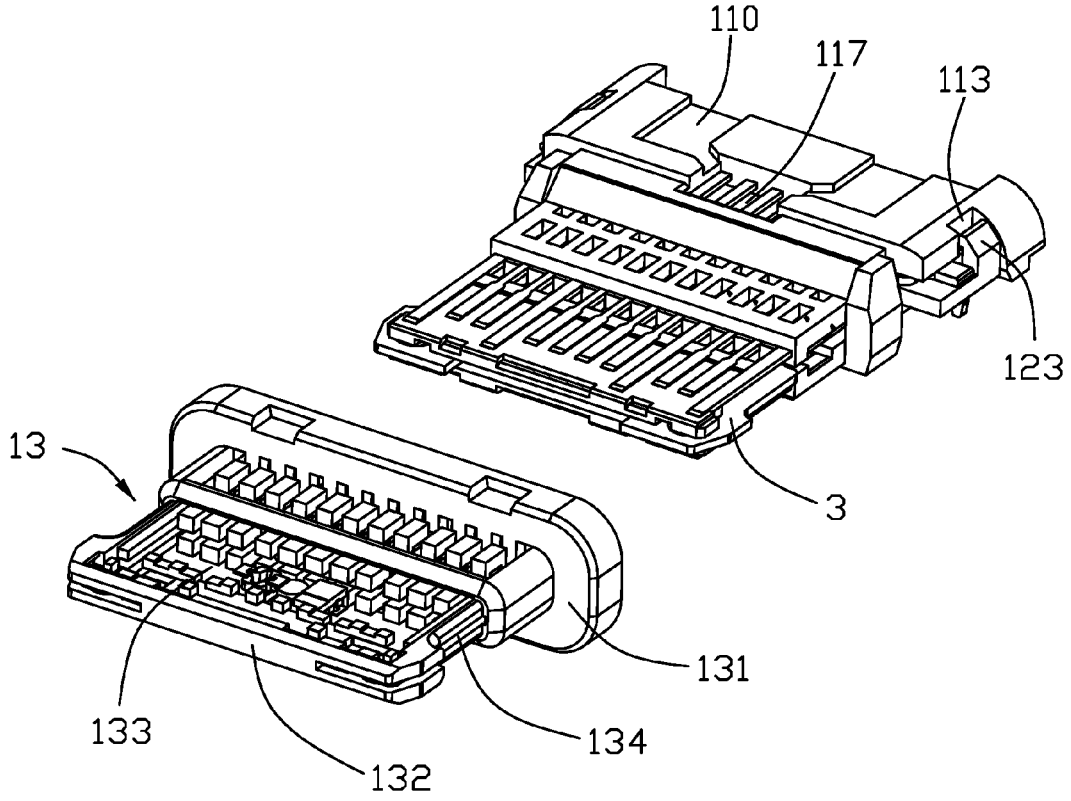
FIG. 4 is a partly exploded perspective view of the terminal module of the receptacle connector.
Figure 5:
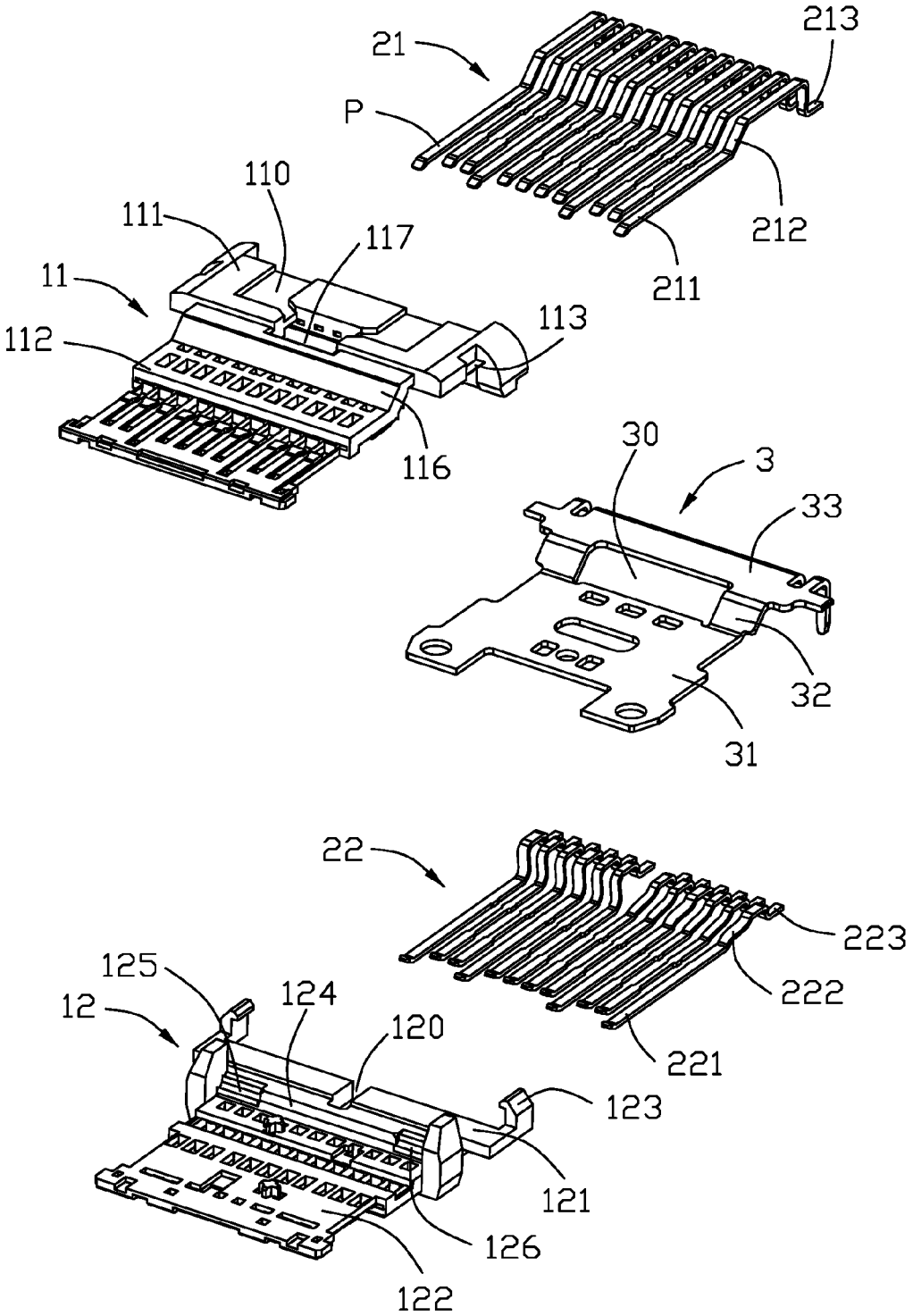
FIG. 5 is a further exploded perspective view of the terminal module without the third insulating housing.
Figure 6:
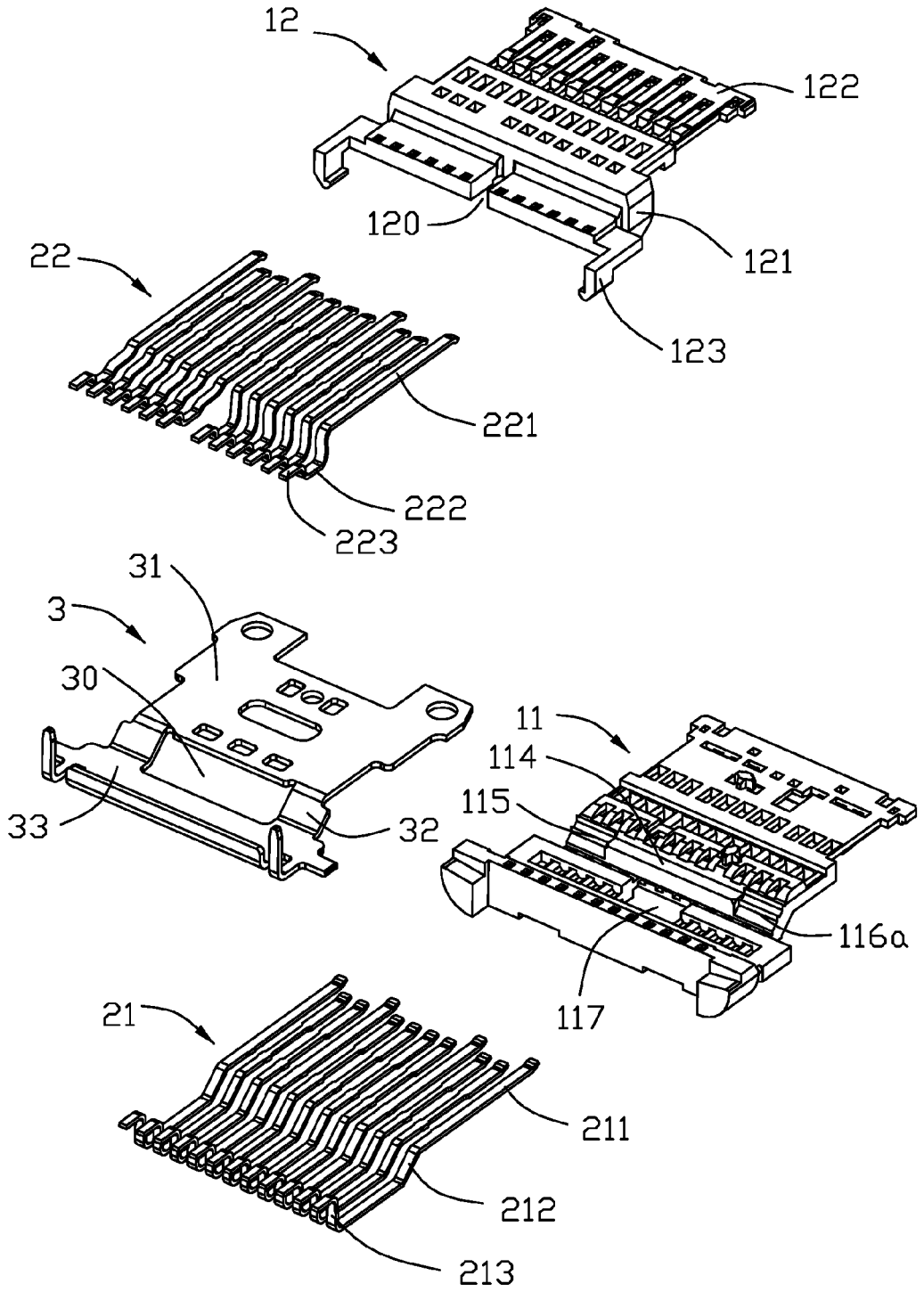
FIG. 6 is another exploded perspective view of FIG. 5.

Referring to FIGS. 4-6, the insulating housing 1 includes a first insulating housing 11, a second insulating housing 12, and a third insulating housing 13. The first insulating housing 11 includes a first base portion 111 and a first tongue portion 112 extending forwardly from the first base portion 111. The first base portion 111 has a pair of depression 113 located at two sides thereof and a guiding recess 110 located at an upper surface thereof. The first tongue portion 112 has a connection portion 116 located close to the first base portion 111 and including at a lower surface 116*a* thereof a first stepping portion or protruding portion 114 protruding downwards and a pair of first ribs 115 at two sides of the stepping portion 117. The first tongue portion 112 has a guiding gap 117 extending to the first base portion 111 and communicating with the guiding recess 110, the guiding gap 117 runs through the first insulating housing 11 in a vertical direction perpendicular to the first mating tongue 112.

Figure 8:
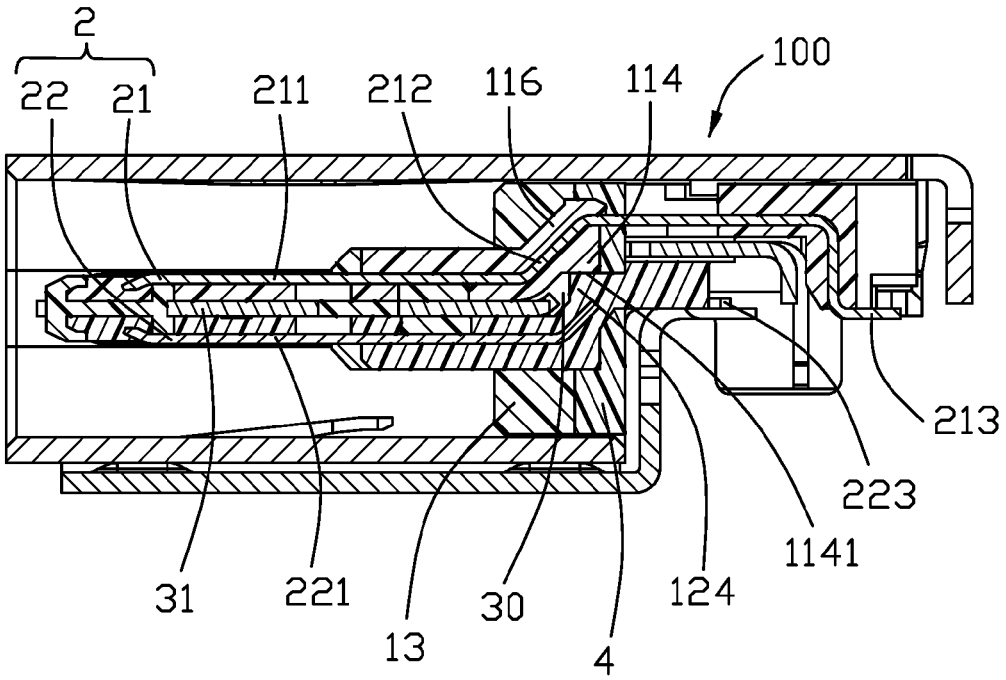
FIG. 8 is a cross-sectional view of the receptacle connector taken along line 8-8 in FIG. 1.
Figure 9:
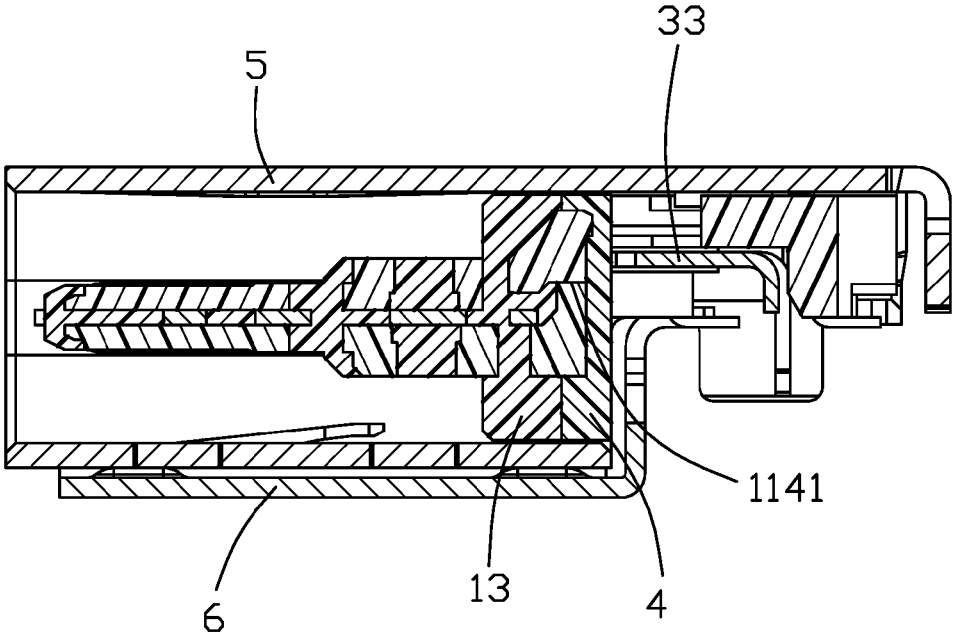
FIG. 9 is a cross-sectional view of the receptacle connector along taken line 9-9 in FIG. 1.
Figure 10:
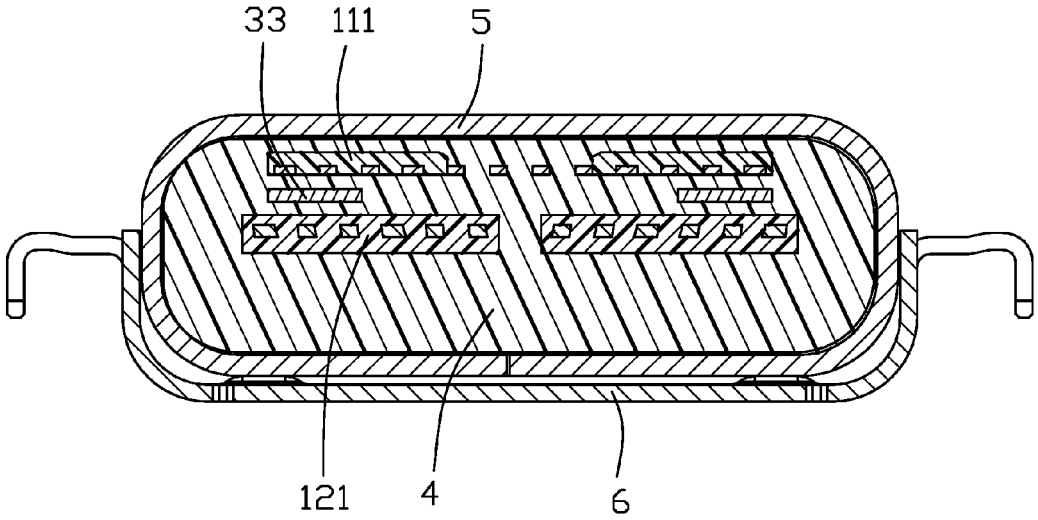
FIG. 10 is a cross-sectional view of the receptacle connector taken along line 10-10 in FIG. 1.
Figure 11:
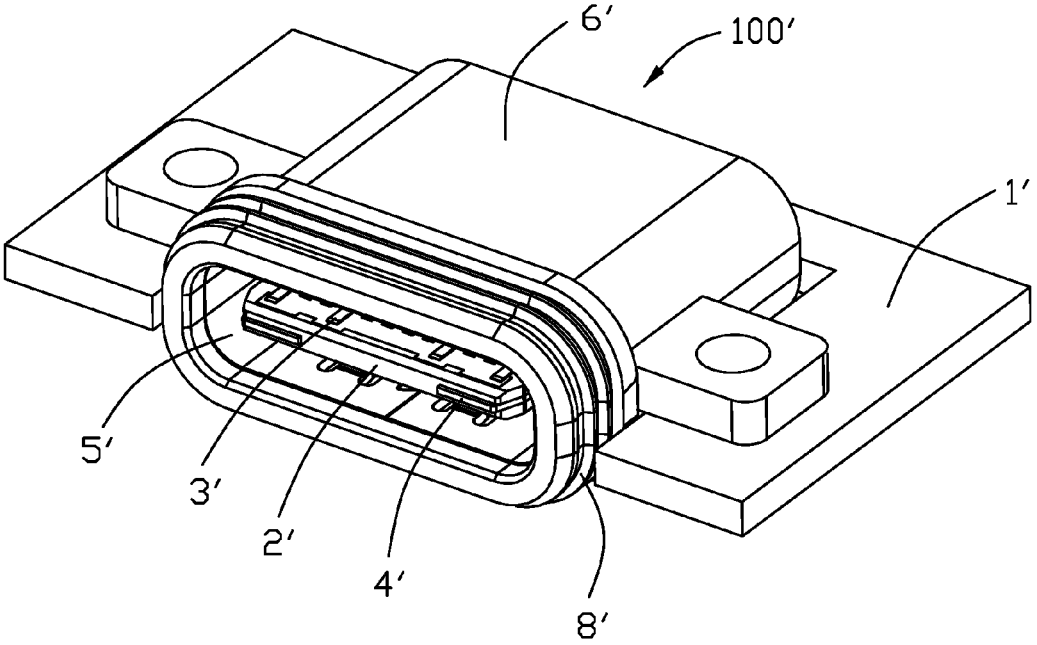
FIG. 11 is a front perspective view of an electrical connector mounted on a printed circuit board of a second embodiment in accordance with the present invention.

The second insulating housing 12 includes a second base portion 121 and a second tongue portion 122 extending forwardly from the second base portion 121. The second base portion 121 has a pair of projections 123 extending upwardly and locking the depressions 113 of the first insulating housing 11. The second tongue portion 122 has a slantwise connection portion 126, which also is defined with a second stepping portion 124 close to the second base portion 121 and located at a middle of an upper surface thereof, and a pair of second ribs 125 in two sides of the second connecting portion 126. In this embodiment, the first stepping portion 114 and the second stepping portion 124 are shaped in right angles and respectively have a pair of flat surfaces 1141 perpendicular to the vertical direction as best shown in FIG. 8. The flat surfaces 1141 are defined as a step surface parallel to a horizontal plane. The step surface of the first stepping portion 114 is located at a lower surface of the first tongue portion 112, and the step surface of the second stepping portion 124 is located at an upper surface of the second tongue portion 122. The second base portion 121 includes a guiding recess 120 communicated with the guiding gap 117. Notably, in the first insulating housing 11, the first base portion 111 and the first tongue portion 112 are located at different levels so the corresponding connection portion 116 lies in an oblique plane, and so the second insulating housing is as well.

The third insulating housing 13 includes a third base portion 131 and a third tongue portion 132 extending forwardly from the third base portion 131. The third tongue portion 132 defines a hollow portion 133 to the first tongue portion 112 and the second tongue portion 122. The third base portion 131 surrounds the first and second base of the first and second insulating housing. The third base portion 131 is abreast of an upper surface of the guiding recess 110 of the first insulating housing 1.

The terminals 2 include a number of first contacts 21 carried within the first insulating housing 11 and a number of second contacts 22 carried within the second insulating housing 12. The first contacts 21 and the second contacts 22 extend in an insertion direction (a front and rear direction), and each includes four power contacts P extending forwardly than other eight signal contacts. The two power contacts in the middle are used to provide electric source and another two are used for electrical grounding. The eight signal contacts include four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Each of the first contacts 21 includes a first contacting portion 211 disposed in the first tongue portion 112, a first soldering portion 213 extending from a back end of the first base portion 111, and a first affixed or middle portion 212 connected with the first contacting portion 211 and the first soldering portion 213 which is embedded in the first base 111 and the first tongue portion 112. The affixed portion 212 extending inclining from the first contacting portion 211, forms an obtuse angle therewith. Each of the second contacts 22 includes a second contacting portion 221 disposed in the second tongue portion 122, a second soldering portion 222 extending from a back end of the second base portion 121, and a second affixed portion 222 connected with the second contacting portion 221 and the second soldering portion 223. The first contacts 21 and the second contacts 22 are positioned to have 180 degree symmetry such that the corresponding plug connector can be inserted and operatively coupled to the receptacle connector 100 in either of two orientations. The first soldering portions 213 and the second soldering portions 223 are located at a same plane and configured in two rows.

Figure 7:
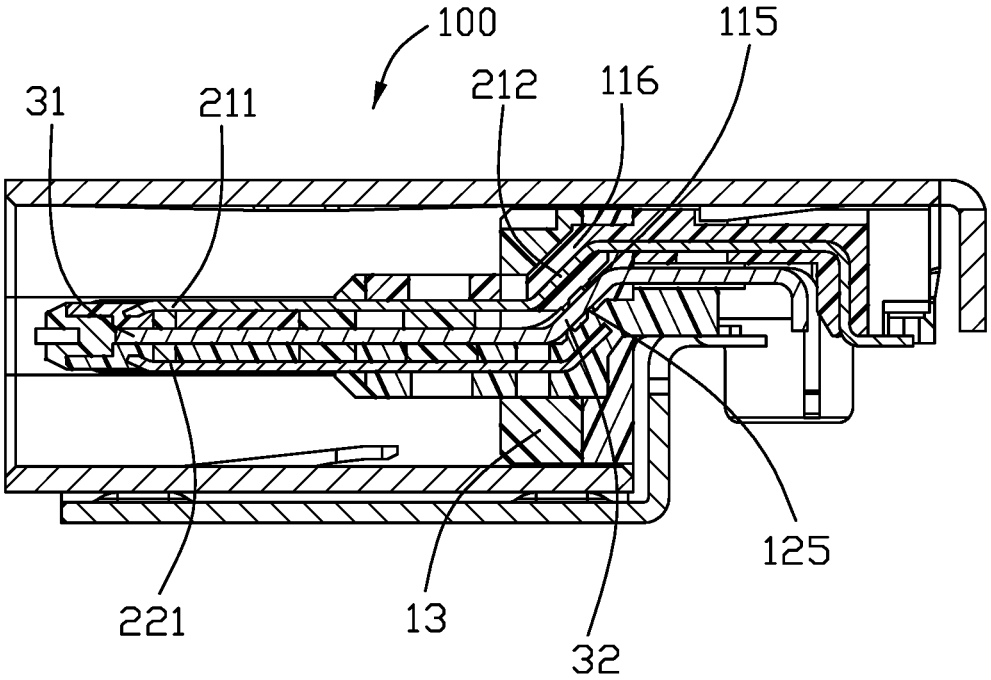
FIG. 7 is a cross-sectional view of the receptacle connector taken along line 7-7 in FIG. 1.

Referring to FIGS. 5-6, the metallic shielding plate 3 sandwiched between the first and the second insulating housing and surrounding by the third insulating housing 13 and disposed between the first and second contacts, includes a front portion 31, a connection portion 32 slantwise extending from the front portion 31, and a rear portion 33 extending backwardly from the connecting portion 32. The connection portion 116, the first affixed portion 212, and the connecting portion 32 incline in a same direction. The connecting portion 32 has an opening 30 which reach to the front and rear portion 31, 33 in a front and rear direction and do not through in a transverse direction of the connector 100. The first stepping portion 114 and the second stepping portion 124 go across the opening 30 and press against each other. The step surface 1141 of the first stepping portion 114 contacts with the step surface of the second stepping portion 124 through the opening 30. The first ribs 115 and second ribs 12 as best shown in FIG. 7 are pressed against the connection portion 32 of the shielding plate 3, which has apertures or escaping space to avoid over cemented in insert-molded process of the third insulating housing 13.

The first insulating housing 11 are embedded with the first contacts 21 by an insert-molding process, the second insulating housing 12 are embedded with the second contacts 22 by another insert-molding process. The shielding plate 3 is then assembled between the first and second insulating housing. The third insulating housing 13 is over-molded with the first insulating housing 11, the metallic shielding plate 3, and the second insulating housing 12 by another insert-molding process to orient the terminals 2 in a right way. Therefore, the insulating housing 1 defines a rear base 101 and a mating tongue 102, the first and second contacting portions 211, 221 are exposed upon the upper and lower surfaces of the mating tongue 102. The step surface 1141 of the first stepping portion 114 contacts with the step surface of the second stepping portion 124 through the opening 30, therefore, a deformation of the first and second insulating housing are avoided, particularly at the connection portions 116, 126 so as to avoid a deformation of the contacts. The soldering portions 213, 223 of the two rows of contacts are of SMT Type and disposed above a lower surface of the mating tongue as best shown in FIG. 8

The shielding shell 5 defines a receiving cavity 501 thereamong and the insulating housing 1 is contained in the receiving cavity 501. The rear base 101 is fitly retained within the shielding shell 5 and the mating tongue 102 extends into the receiving cavity 501. The shielding shell 5 includes a top wall 51 with sealing protruding ribs 511 and a bottom wall 52 with spring tangs 521 extending into the receiving cavity 501, a pair of side walls 53 connected with the top wall 51 and the bottom wall 52, and a rear wall 54 separated with the bottom wall 52 and bending from the top wall 511 to cover an upper half of the rear end of the insulating housing 1.

Figure 2:
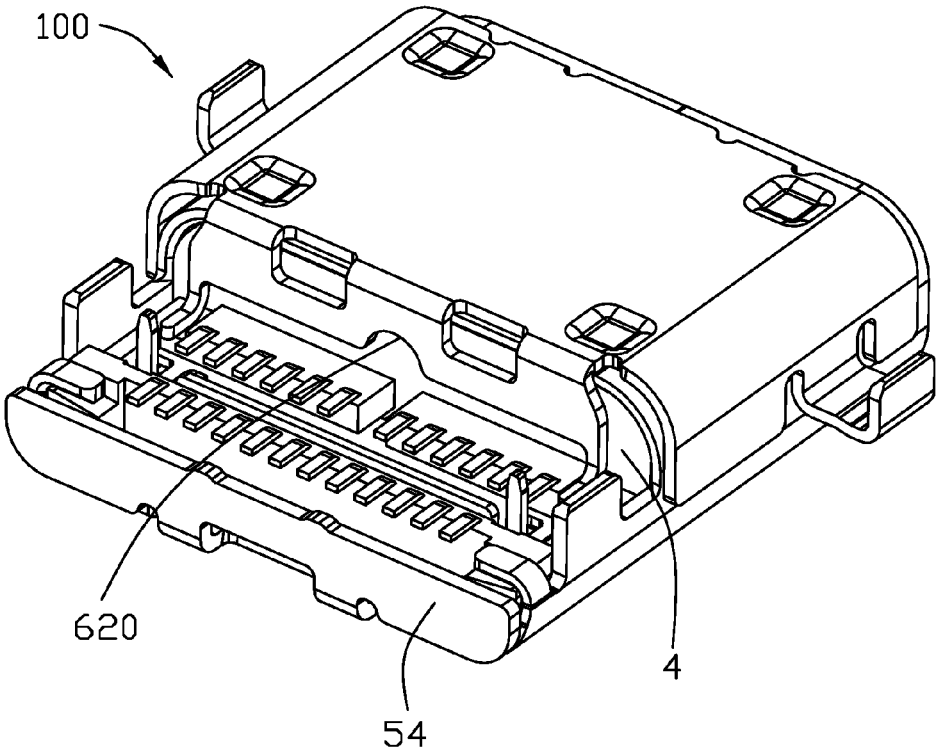
FIG. 2 is a rear and bottom perspective view of the receptacle connector shown in FIG. 1.
Figure 3:
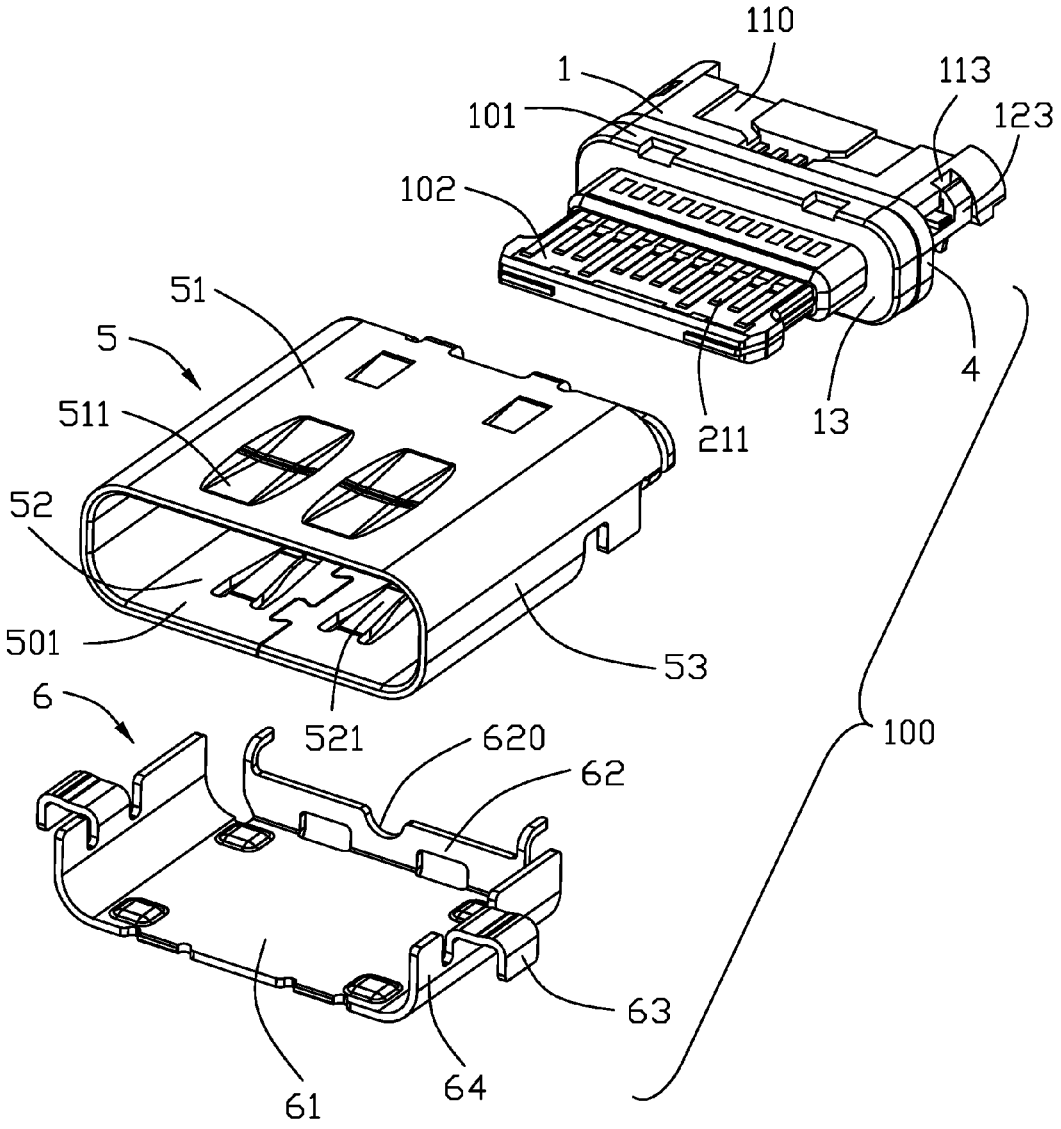
FIG. 3 is a partly exploded perspective view of the receptacle connector shown in FIG. 1.

Referring to FIGS. 2-3, the metallic shell 6 includes a main portion 61 covering the bottom wall 52 of the shielding shell, a back portion 62 extending upward from a rear end of the main portion 61 to cover a lower half of the rear end of the insulating housing 1, and a pair of side portion 64 extending from sides of the main portion 61. A pair of affixed legs 63 extends from the side portions 64. The rear portion 62 shields after the glue wall 4 and has a aperture 620 to increase dimension in flowing glue.

FIGS. 11-18 illustrates a second embodiment of a receptacle connector 100', which includes an insulating housing 2', a plurality of contacts 3' retained to the housing 2', a shielding shell 5' secured to the housing to form a mating cavity for receiving a plug, and a printed circuit board or substrate 1' to which the contacts 3' are mounted. The electrical connector 100' further includes an insulating cover 6' enclosing the shell 5', and a sealing member 7', e.g., a bonding material, glue, epoxy, etc., at a rear of the shell 5'. The cover 6' is so mounted to enclose the housing 2' and the shell 5' as to define a chamber 61' for forming the sealing member 7' after the contacts 3' are mounted to the substrate 1', e.g., by surface-mount soldering, through-hole inserting, etc. The substrate 1' has a front edge portion extending into the chamber 61'.

Figure 15:
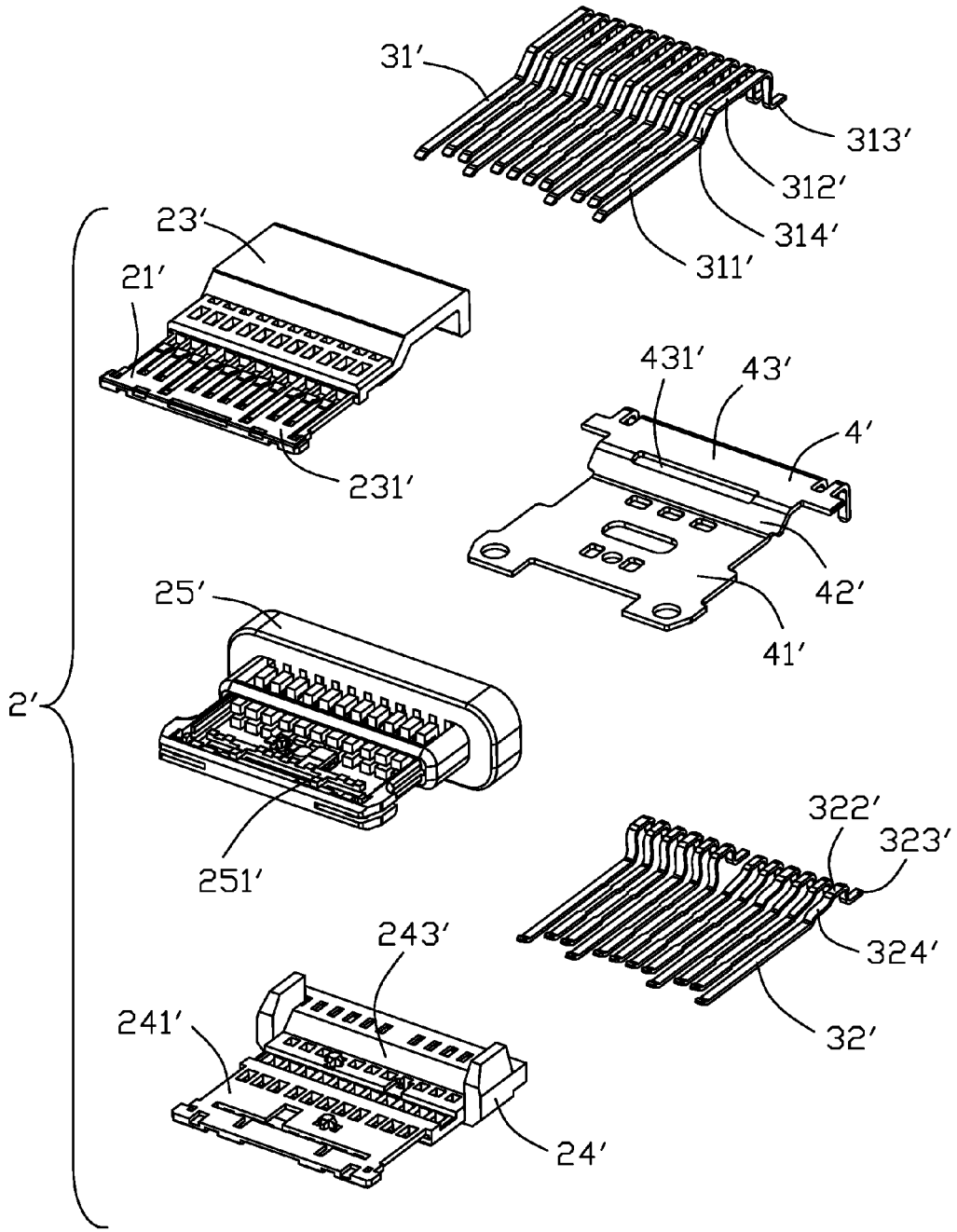
FIG. 15 is an exploded perspective view of a terminal module of the electrical connector.
Figure 16:
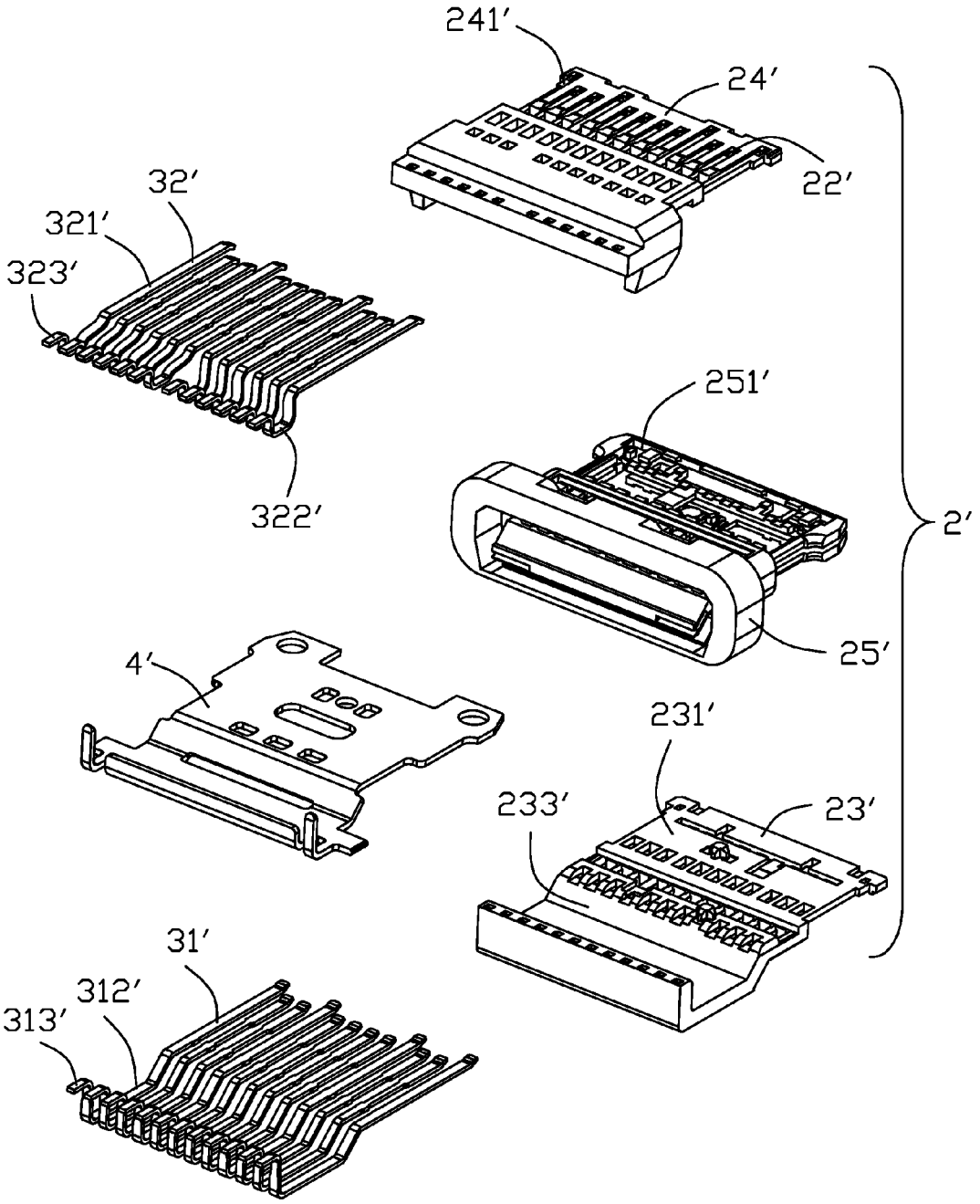
FIG. 16 is another exploded perspective view of the terminal module.

Referring specifically to FIGS. 15-16, the electrical connector 100' further includes a metallic shielding plate 4'. The housing 2' includes an upper insulating housing 23' and a lower insulating housing 24' separated by the plate 4' and a third insulating housing 25'. The upper insulating housing 23' is insert-molded with associated contacts 31' as an upper terminal module, and the lower insulating housing 24' is insert-molded with associated contacts 32' as a lower terminal module. The shielding plate 4' is sandwiched between the upper and lower insulating housing 23' and 24', the third insulating housing 25' is formed by a second molding process and surrounding the assembled upper and lower insulating housing and the shielding plate so as to form the complete housing 2' loaded with the contacts 3' therein. The insulating housing includes a rear base 201', a front mating tongue 202' with thicken step 203' at a root thereto to the rear base. The shielding plate 4 includes a front portion 41', a rear portion 43' and a slant connection portion 42' jointing the front and rear portion located at a different level. The upper and lower insulating housing defines corresponding confronting faces 233', 243' pressing against the slanting connection portion 42' of the shielding plate 4'. The slanting connection portion 43' of the shielding plate benefit a shortage of a length of the receptacle connector 100'. The contacts also have corresponding slanting portions 314', 324'. The slanting portions of the contacts and the connection portion 42' of the shielding plate are parallel to each other. The shielding plate defines a long slit 431' at a joint of the connecting portion and rear portion thereof.

The housing 2' has an upper surface 21' at the upper insulating housing 23' and a lower surface 22' at the lower insulating housing 24'. The upper insulating housing 23' has an upper tongue 231', the lower insulating housing 24' has a lower mating tongue 241', and the third insulating housing 25' has a front tongue 251'.

Figure 17:
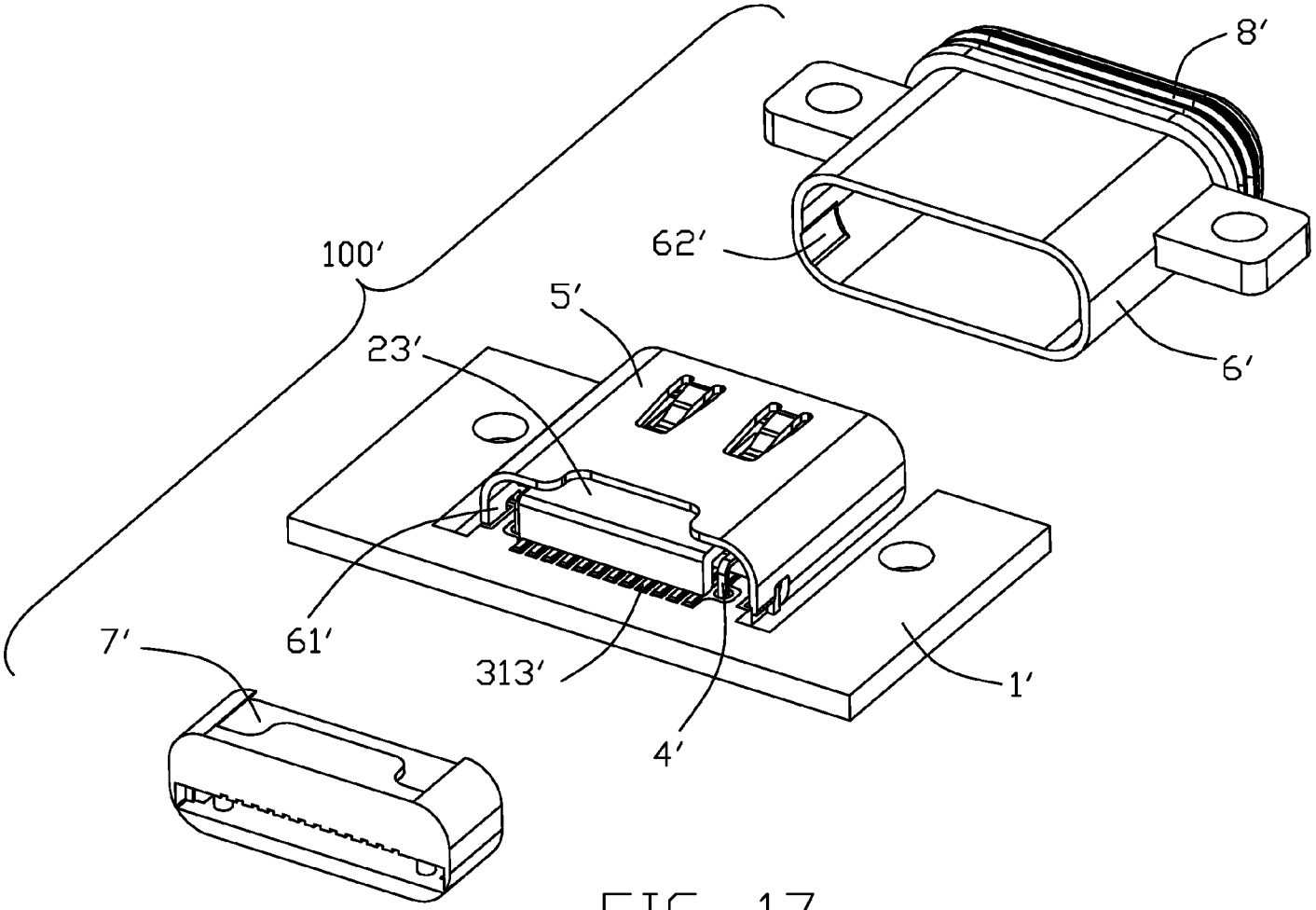
FIG. 17 is an exploded perspective view of the electrical connector schematically showing a cover thereof at a state prior to mounting to a shield thereof to form a sealing structure.
Figure 18:
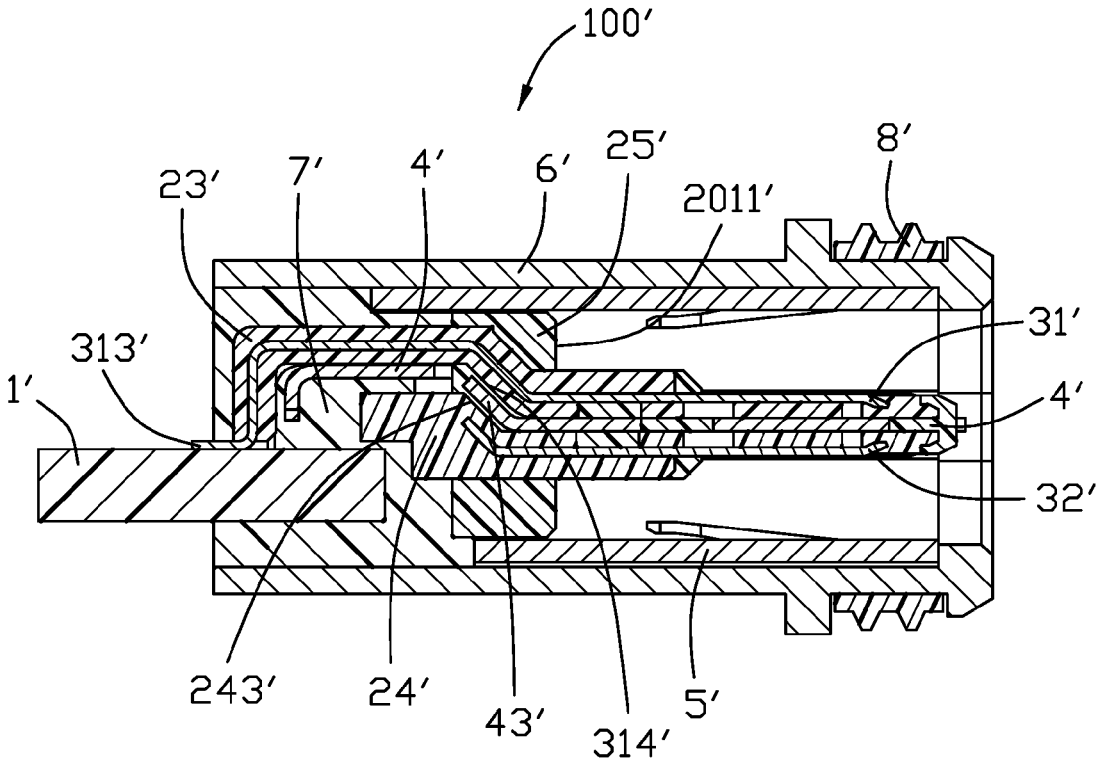
FIG. 18 is a cross-sectional view of the electrical connector taken along line 18-18 in FIG. 12.

Referring to FIGS. 13-18, each of the upper row of contacts 31' has a contacting portion 311' exposed to the upper surface 21', a soldering portion 313', and a middle portion 312'. Each of the lower row of contacts 32' has corresponding contacting portion 321', soldering portion 323', and middle portion 322'. The soldering portions 313' and 323' of the upper and lower rows of contacts 31' and 32' extend behind respective rear ends of the upper and lower insulating housing 23' and 24'. Each of the middle portions defining a slanting portion 314', 324' located behind a front surface 2011' of the rear base, connection portion 43' of the shielding plate is shaped in a slant way and located behind the front surface of the rear base to achieve a shortage of the receptacle connector as best shown in FIG. 18.

Referring specifically to FIGS. 11-14 and 17-18, the insulating cover 6' is a sleeve-like member and has a lengthwise dimension greater than either the housing 2' or the shell 5'. The insulating cover 6' is mounted to the shell 5' after the upper and lower rows of contacts 31' and 32' are soldered to the substrate 1'. The chamber 61' is defined at a rear of the cover 6' and extends forwardly to a rear of the third insulating housing 25'. The substrate 1' has an edge portion extending into the chamber 61'. The cover 6' has a pair of inner grooves 62' for accommodating a part of the substrate edge portion. A waterproof ring or seal 8' is provided around a front of the cover 6'.

Figure 12:
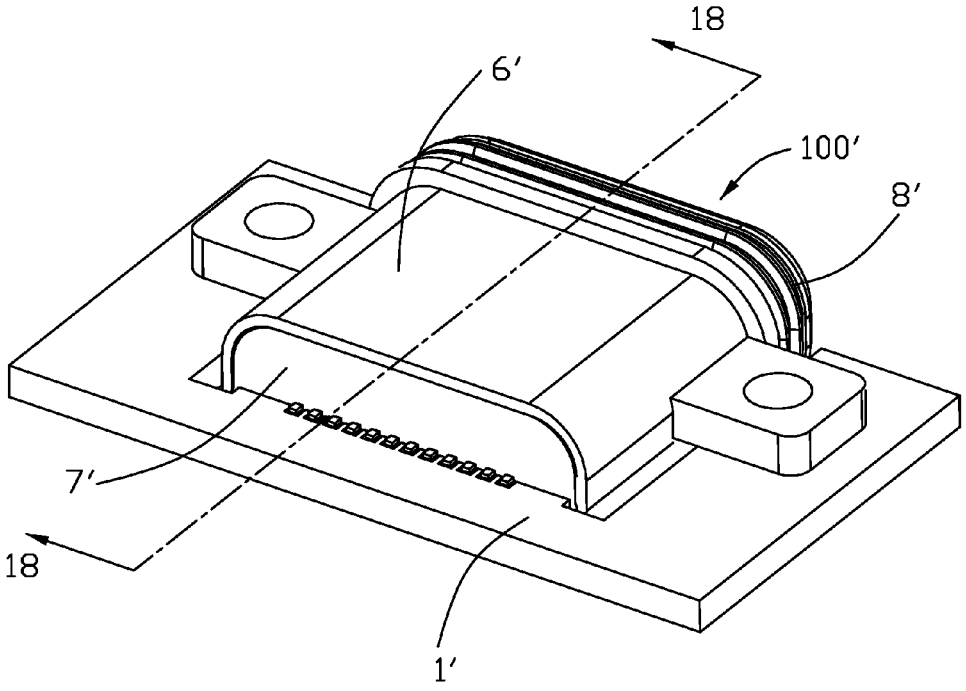
FIG. 12 is a rear perspective view of the electrical connector shown in FIG. 11.
Figure 13:
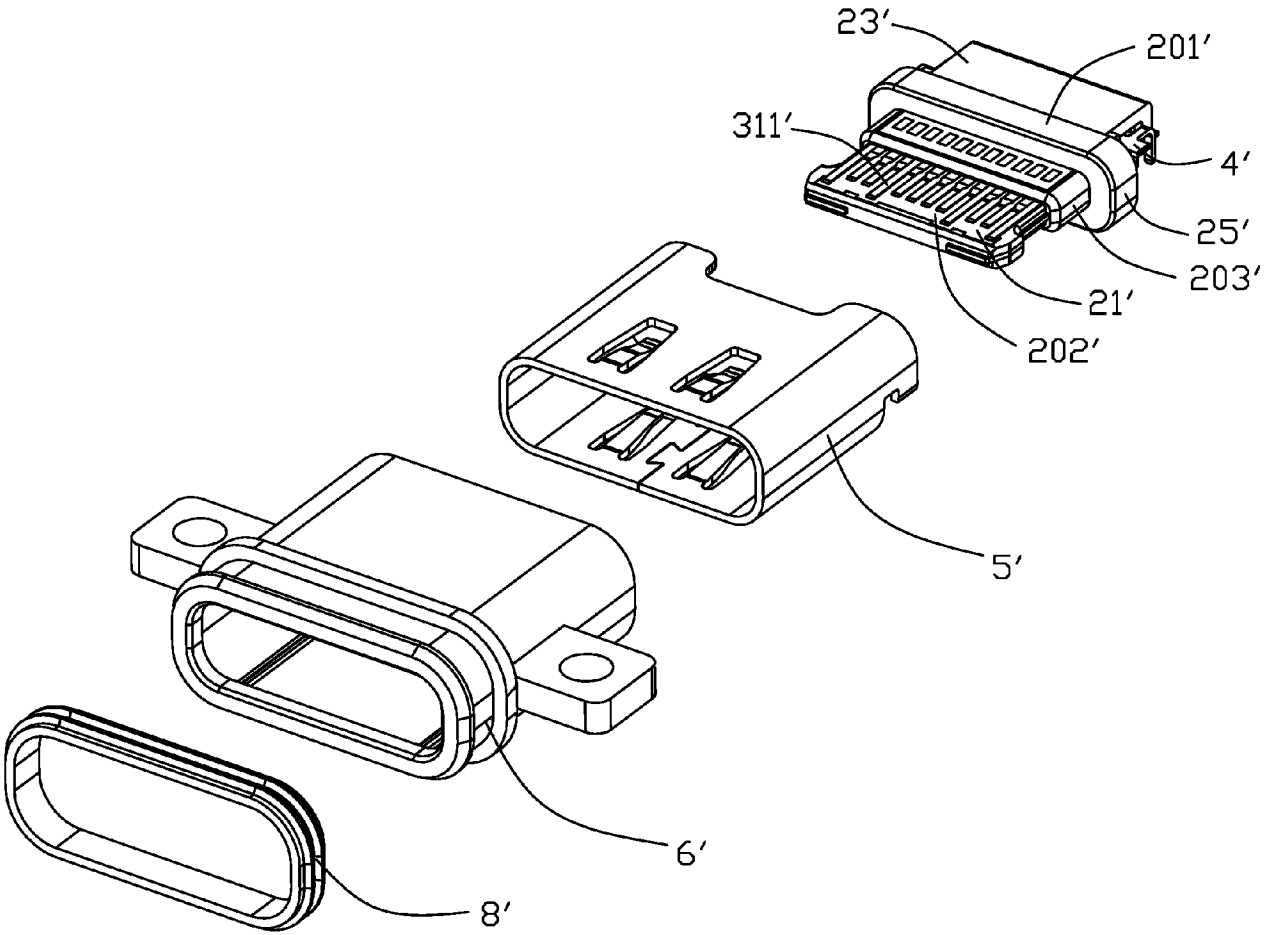
FIG. 13 is an exploded perspective view of the electrical connector.
Figure 14:
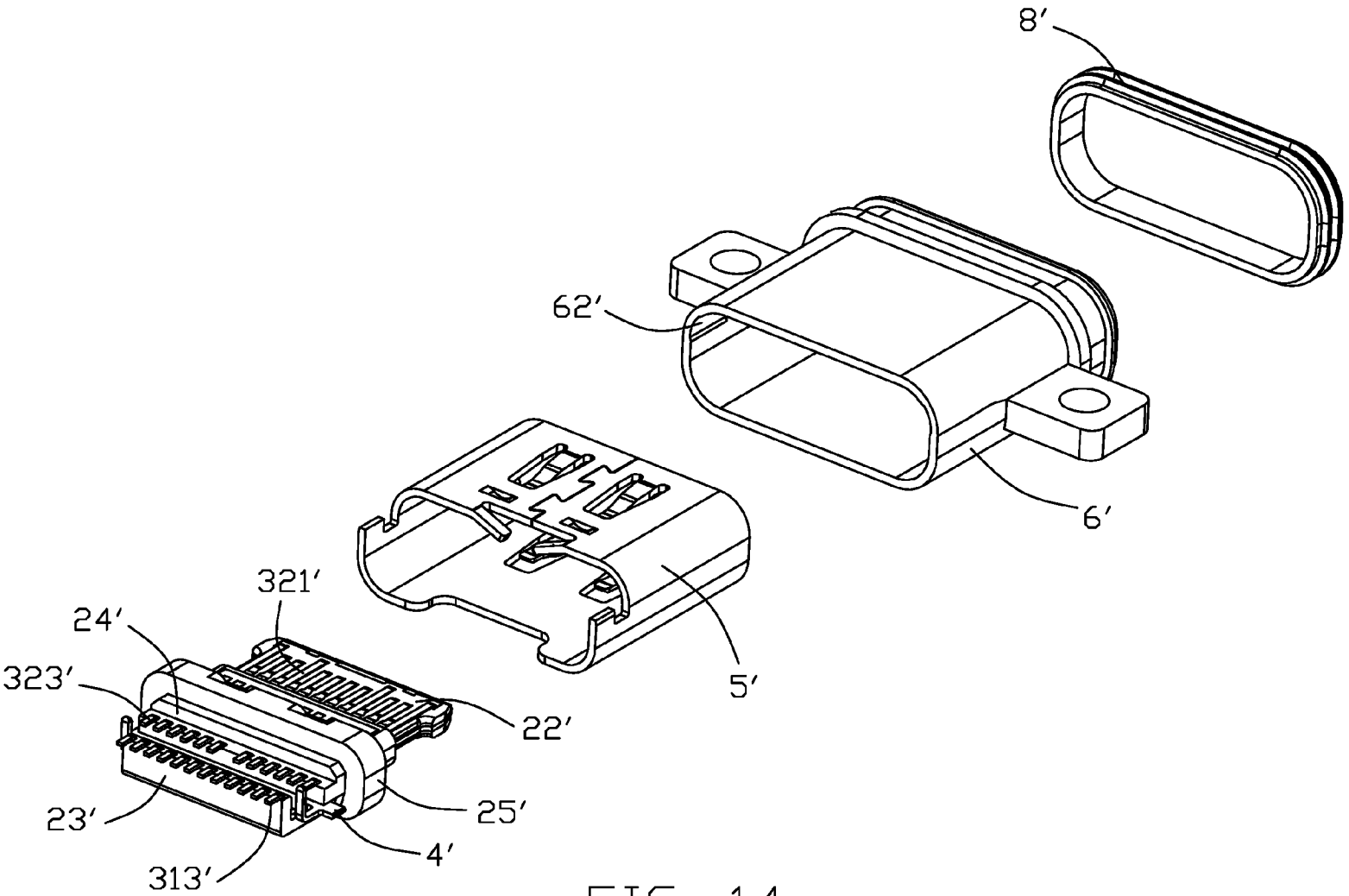
FIG. 14 is another exploded perspective view of the electrical connector.

Referring specifically to FIGS. 12 and 17-18, the sealing member 7' is formed by applying epoxy or like material in the chamber 61' and solidifying the same. Therefore, the member 7' seals gaps among rear ends of the upper and lower insulating housing 23' and 24', the soldering portions 313' and 323' of the upper and lower rows of contacts 31' and 32', rear end of the shell 5', the edge portion of the substrate 1', and the cover 6'.

The steps of manufacturing the electrical connector 100' are as follows: mounting the metallic shell 5' to a combined insulating housing 2' and electrical contacts 31' and 32'; connecting the substrate 1' to the electrical contacts 31' and 32'; enclosing the insulating cover 6' over the shell 5' and an edge portion of the substrate 1' to define the chamber 61'; and sealing the chamber 61'. The substrate 1' may suitably be a mother board or a daughter board to be electrically connected to another mother board. The insulating cover 6' is mounted to the metallic shell 5' after the substrate 1' extends into the chamber 61' and is soldered to the contacts 3', the sealing member 7' may be advantageously formed in the chamber 61'. Notably, in this embodiment the chamber 61' is formed by cooperation of the cover 6', the housing 2' and the shell 5'. Anyhow, if the shell 5' extends further rearward to cover the rear portion of the upper insulating housing 23' in the vertical direction, the chamber 61' may be formed by the shell 5' and the housing 2' only instead.

However, the disclosure is illustrative only, changes may be made in detail, especially in matter of shape, size, and arrangement of portions within the principles of the invention.

What is claimed is:

1. A receptacle connector comprising:

a first insulating housing having a first base portion and a first tongue portion extending forwardly from the first base portion, the first tongue portion having a slant connection portion located close to the first base portion;

a second insulating housing having a second base portion and a second tongue portion extending forwardly from the second base portion, the second tongue portion having a slant connection portion located close to the second base portion;

a plurality of first contacts carried within the first insulating housing, each first contact having a first contacting portion, a first affixed portion, and a first soldering portion;

a plurality of second contacts carried within the second insulating housing, each second contact having a second contacting portion, a second affixed portion, and a second soldering portion;

a shielding plate sandwiched between the first insulating housing and the second insulating housing, the shielding plate having a slant connection portion sandwiched between the connection portions of the first and second insulating housing;

wherein the connecting portion of the shielding plate defines an opening, the first insulating housing defines a first stepping portion going through the opening and pressing against the second insulating housing;

wherein the second insulating housing defines a second step portion, and the first stepping portion presses against the second step portion.

2. The receptacle connector as claimed in claim 1, wherein the first and the second stepping portion respectively have a step surface which confronts each other in a vertical direction.

3. The receptacle connector as claimed in claim 2, wherein the first stepping portion and the second stepping portion are shaped in right angles and respectively have a pair of flat surfaces.

4. The receptacle connector as claimed in claim 1, wherein the shielding plate comprises a front portion, a rear portion and the connecting portion connecting with the front and rear portion, the opening reaches to the front section and the rear section in a front and rear direction.

5. The receptacle connector as claimed in claim 4, wherein the first insulating housing has ribs located at two sides thereof, the second stepping portion has ribs located at two sides thereof, the ribs are pressed against opposite faces of the shielding plate.

6. A receptacle connector comprising:

an insulating housing comprising a base and a mating tongue extending from the base;

two rows of contacts loaded in the insulating housing with contacting portions exposing to opposite surfaces of the mating tongue, soldering portions and middle portions connecting with the contacting portions and the soldering portions respectively;

a shielding plate disposed in the insulating housing and between the two rows contacts, and comprising a front portion, a rear portion and a connecting portion connecting with the front portion and rear portion;

wherein the front portion and the rear portion are located at different level and parallel to each other, and the connecting portion are shaped on a slant to achieve a shortage of the receptacle connector; wherein the middle portions of the contacts define slanting portions parallel to the connecting portion of the shielding plate.

7. The receptacle connector as claimed in claim 6, wherein the shielding plate defines a long slit at a joint of the connecting portion and the rear portion thereof.

8. The receptacle connector as claimed in claim 6, wherein the insulating housing defines a plurality of ribs pressing against the connection portion of the shielding plate.

9. The receptacle connector as claimed in claim 6, wherein the connection portion of the shielding plate defines an opening, the insulating housing defines a step portion going across the opening.

10. A sink-in type receptacle connector comprising:

an insulating housing comprising a rear base and a front mating tongue extending from the base, the front mating tongue defining a thicken step at a root thereof to the rear base;

two rows of contacts loaded in the insulating housing with contacting portions exposing to opposite surfaces of the mating tongue in front of the thicken step, soldering portions beyond the rear base and middle portions connecting with the contacting portions and the soldering portions respectively, each of the middle portions defining a slanting portion located behind a front surface of the rear base;

a shielding plate disposed in the insulating housing and between the two rows contacts, and comprising a horizon front portion, a horizon rear portion and a connection portion connecting with the front portion and rear portion;

wherein the connection portion of the shielding plate between the two rows contacts is shaped in a slant way and located behind the front surface of the rear base to achieve shortness of the receptacle connector along a front-to-back direction.

11. The receptacle connector as claimed in claim 10, wherein the soldering portions of the two rows of contacts are of SMT Type and disposed above a lower surface of the mating tongue.

12. The receptacle connector as claimed in claim 10, wherein the insulating housing comprises a first insulating housing loaded with a first row of the contacts and a second insulating housing loaded with a second row of the contacts, each of the first and second insulating housing defines a slanting face thereof corresponding to the connection portions of the shielding plate, the first insulating housing defines a step portion from the slanting surface which goes across an opening defined in the shielding plate and press against the connecting portion of the second insulating housing.

13. The receptacle connector as claimed in claim 12, wherein the second insulating housing defines a step portion from the slanting surface thereof which goes across the open and press against the connecting portion of the first insulating housing.

14. The receptacle connector as claimed in claim 10, wherein the insulating housing comprises a first insulating housing loaded with a first row of the contacts and a second insulating housing loaded with a second row of the contacts, each of the first and second insulating housing defines a slanting face thereof corresponding to the connection portions of the shielding plate, the first and the second insulating housing defines ribs pressing against opposite surfaces of the connecting portion of the shielding plate.

* * * * *